US008991504B2

(12) United States Patent
Hansen

(10) Patent No.: US 8,991,504 B2
(45) Date of Patent: Mar. 31, 2015

(54) SINGLE AND MULTI-CHAMBER WELLBORE PUMPS FOR FLUID LIFTING

(75) Inventor: Henning Hansen, Alicante (ES)

(73) Assignee: Hansen Energy Solutions LLC, The Woodlands, TX (US)

( * ) Notice: Subject to any disclaimer, the term of this patent is extended or adjusted under 35 U.S.C. 154(b) by 0 days.

(21) Appl. No.: 14/119,883

(22) PCT Filed: Apr. 4, 2012

(86) PCT No.: PCT/US2012/032208

§ 371 (c)(1),
(2), (4) Date: Jan. 10, 2014

(87) PCT Pub. No.: WO2012/170112

PCT Pub. Date: Dec. 13, 2012

(65) Prior Publication Data

US 2014/0127065 A1 May 8, 2014

Related U.S. Application Data

(60) Provisional application No. 61/494,557, filed on Jun. 8, 2011.

(51) Int. Cl.

| | |
|---|---|
| ***E21B 43/12*** | (2006.01) |
| ***F04B 49/04*** | (2006.01) |
| ***F04B 47/12*** | (2006.01) |
| ***F04B 53/10*** | (2006.01) |

(52) U.S. Cl.

CPC ..... *F04B 49/04* (2013.01); *E21B 43/129* (2013.01); *F04B 47/12* (2013.01); *F04B 53/1005* (2013.01)

USPC ..... 166/372; 166/68; 166/105

(58) Field of Classification Search

USPC ..... 166/372, 68, 105, 108

See application file for complete search history.

(56) References Cited

U.S. PATENT DOCUMENTS

| | | | | |
|---|---|---|---|---|
| 3,873,238 | A * | 3/1975 | Elfarr | 417/54 |
| 8,408,306 | B2 * | 4/2013 | Arizmendi et al. | 166/310 |
| 2004/0216886 | A1 | 11/2004 | Rogers | |
| 2005/0150224 | A1 | 7/2005 | Hoffarth | |
| 2009/0321084 | A1 | 12/2009 | Simmons | |

FOREIGN PATENT DOCUMENTS

WO 8602412 A1 4/1986

OTHER PUBLICATIONS

For the American Heritage Dictionary definition: alone. (n. d.) The American Heritage® Dictionary of the English Language, Fourth Edition. (2003). Retrieved Jul. 31, 2014 from http://www.thefreedictionary.com/alone.*

Notification of transmittal of the international search report and the written opinion of the international searching authority, or the declaration, PCT/US2012/032208, Oct. 18, 2013.

International Preliminary Examination Report on Patentability, PCT/US2012/032208, Dec. 10, 2013.

* cited by examiner

*Primary Examiner* — Brad Harcourt
*Assistant Examiner* — Wei Wang
(74) *Attorney, Agent, or Firm* — Richard A. Fagin; Adenike Adebiyi

(57) ABSTRACT

A wellbore pump includes a pump housing suspendible in a wellbore at ends of at least one of a power fluid line and a fluid discharge line. The pump housing includes a fluid inlet proximate a bottom end thereof and wherein the fluid discharge line is coupled proximate a top end thereof. The pump include valves for directing flow of wellbore fluid out of the housing when power fluid displaces fluid in the housing, the valves for directing flow of wellbore fluid into the housing when power fluid pressure is relieved.

8 Claims, 10 Drawing Sheets

*Inject/bleed off cycle from surface pump*

*Inject/bleed off cycle from surface pump*

SINGLE AND MULTI-CHAMBER WELLBORE PUMPS FOR FLUID LIFTING

BACKGROUND

This disclosure relates generally to the field of wellbore pumps for use in hydrocarbon producing wellbores. More specifically, the disclosure relates to a wellbore-deployed pump that can be operated by compressed gas, air or hydraulic fluid from the surface.

Certain subsurface hydrocarbon producing wells require some sort of artificial lift for reservoir fluids to be transported to the surface when the energy in the reservoir is not sufficient to move the fluids to the surface. There are a number of methods and apparatus for such purpose. Wellbore pumps of different constructions and using various methods of installation exist, but pumps known in the art may be complicated and/or require the use of a drilling rig or a workover rig to be deployed and replaced.

Wellbore deployed pumps known in the art may be powered either by electric cable extending from the surface to an electric submersible pump (ESP) deployed in the wellbore, or by sucker rods connected to a surface drive mechanism. These pump systems may be susceptible to mechanical failures when used in highly deviated tot horizontal wellbore sections, and they typically require a drilling- or work-over rig to be installed and retrieved. In addition, such pump systems may require a production tubing string within the casing to operate. Gas wells often suffer from produced water buildup, particularly from the lower side of the well when such wells are highly inclined or horizontal. The produced water can eventually halt production of gas by exerting hydrostatic pressure against the producing formation.

There is a need for simpler and lower cost pump systems that require no rig for installation or retrieval and do not require production tubing to operate. In addition it has been identified that electrical submersible pumps used for oil well production may be costly and available from a limited number of manufacturers. Hence, there is also a need methods and pumps for removing produced water on a continuous basis wherein existing pump systems are typically complicated and/or require a drilling rig or workover rig to be deployed and replaced.

SUMMARY

One aspect of the disclosure is a wellbore pump that can be deployed in a wellbore without a drilling rig or workover rig to lift fluids to the surface. The pump may be operated by power fluid from the surface, where the power fluid pushes wellbore fluids within the pump into an hydraulic conduit to the surface. Bleeding off the pressure of the power fluid results in the pump resetting to draw in new wellbore fluids. Repeating the foregoing pressurizing and bleeding off pressure of power fluid results in a substantially continuous transport of wellbore fluids to the surface.

In one example embodiment, the pump can also contain a rapid bleed off mechanism where the power fluid be bled off into the wellbore instead of to the surface, thereby increasing pumping speed.

In another aspect the disclosure relates to a wellbore pump including a tube extended into a production tubing to a position above a bottom end thereof. The production tubing is disposed with in a casing disposed in a wellbore. A first annular space between the production tubing and the casing is sealed by an annular seal. A check valve is disposed proximate the bottom of the tube and is oriented to stop flow of fluid out of the bottom of the tube. A check valve is disposed proximate the bottom of the production tubing and oriented to stop flow of fluid out of the production tubing. Pressurization of a second annular space between the tube and the production tubing urges fluid present therein, in the first annular space and the production tubing to move upwardly into the tube. Depressurization of the second annular space enables wellbore fluid to enter the tube, the second annular space and the production tubing.

Example embodiments of such pumps may be retrofitted into existing wellbores, without having to pull an existing wellbore completion, which is typically very costly. The pumps may be readily be scaled in size for the required fluid lift rate, by extending or lowering the length and diameter of the pump as well as adjusting the cycling frequency of the pump.

Arrows illustrate gas, air and fluids transport direction. A check valve in the fluid discharge line prevents fluids already pushed out of the pump to be drawn back into the pump. A overpressure valve can be incorporated in the top of the pump to avoid over-pressurizing the pump. Alternatively a "smart" valve arrangement, can replace this overpressure valve, where the "smart" valve arrangement would dump power air, gas or fluids into the wellbore instead of bleeding this to surface via the power tube, while temporarily isolating the high pressure feed line into the pump. This will increase the pump frequency.

Figure 13:
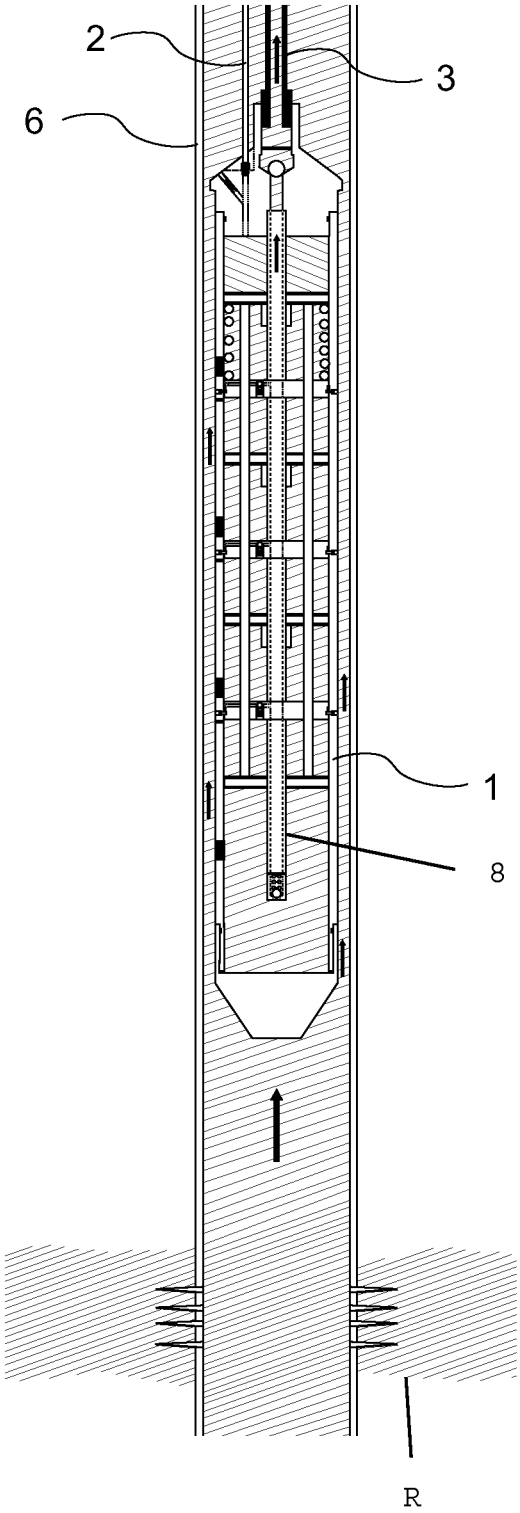

FIG. 13 illustrates a free hanging pump as described with respect to the other figures, wherein the free hanging pump may be deployed within a tubular that can be tubing or casing, wherein wellbore fluids are pushed to the surface in a dedicated spooled or jointed tube.

Figure 14:
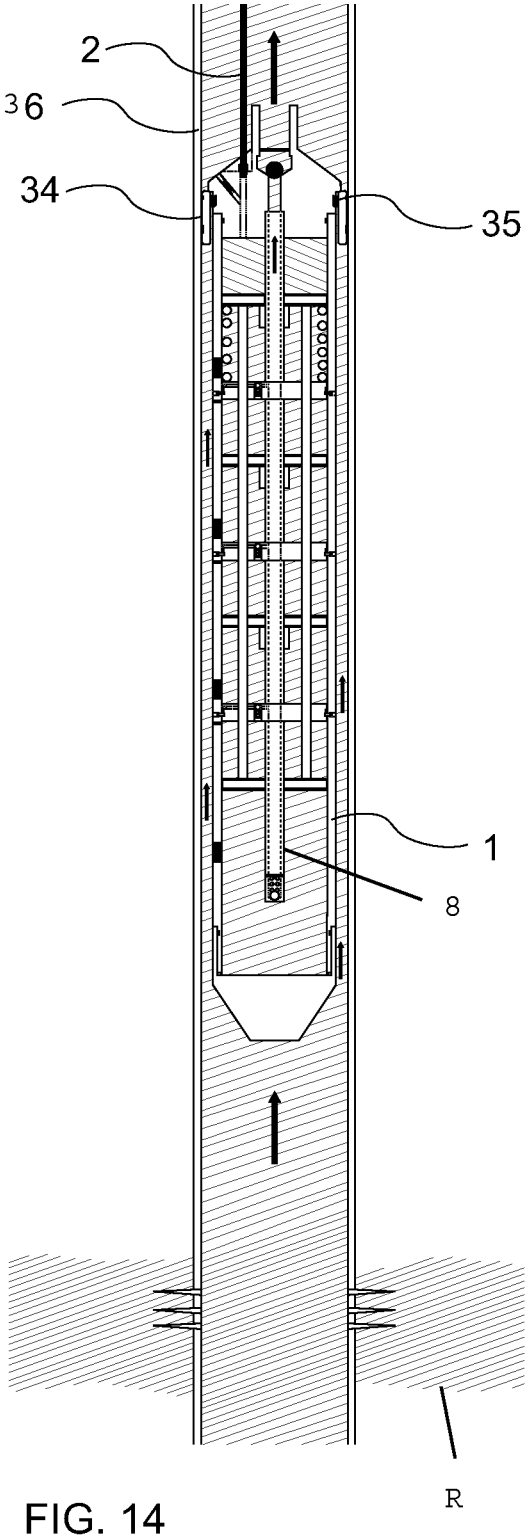

FIG. 14 illustrates a pump system as in the previous figures, wherein this a pump may be hung off within a wellbore tubular onto a pre-installed or intervention installed hanger. The pump housing may contain a sealing arrangement so that wellbore fluids pumped into the wellbore above the pump will not return to below the pump. Such example only requires a tube for the pressurized air, gas or fluids, thus eliminating the need for a pump discharge tube extending to the surface.

Figure 3:
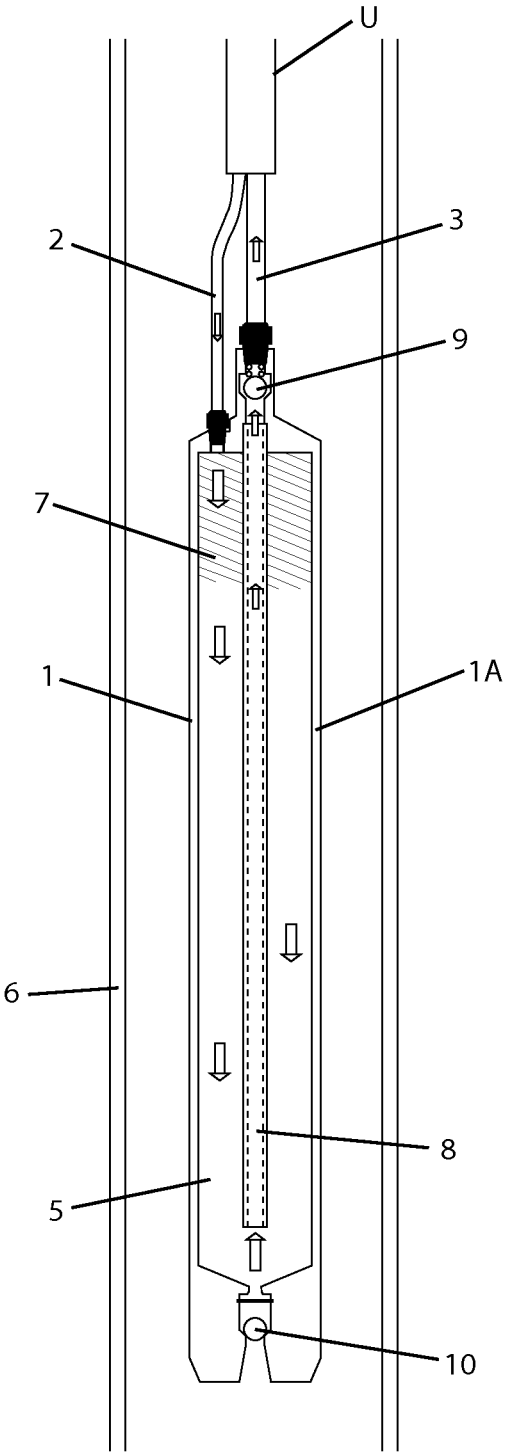
FIG. 3 illustrates the pump described in FIG. 2, where the air, gas or fluid is injected into the pump housing to push out wellbore fluid therefrom into a discharge tube. A check valve at the pump intake will close by this action, while a check valve in the upper section of the pump will open. Continued injection of air, gas or fluids into the pump will evacuate all wellbore fluids from the pump housing.
Figure 15:
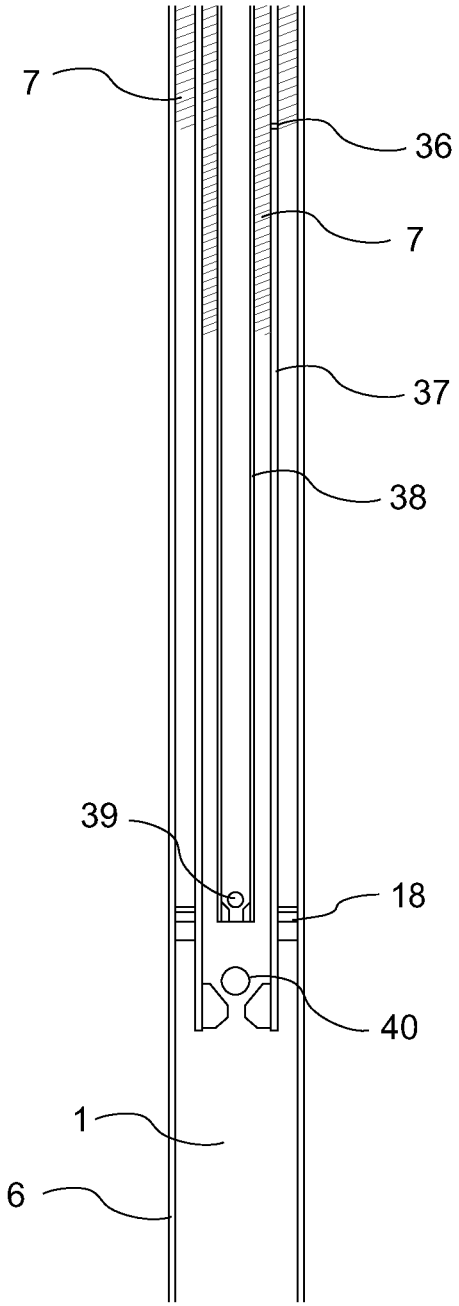

FIG. 15 illustrates a pump using tubulars extending into the wellbore from the surface, where an inner jointed or coiled tube may be hung off within a production tubing string that has been perforated so that pressurized air, gas or fluid can be injected from the surface along the same principle as the pump shown in FIG. 3. The inner tube may contain a check valve preventing wellbore fluids from draining back into the wellbore. The production tubing may also contain a check valve that prevents wellbore fluids from draining into the wellbore as well as providing a pressure lock when pumping pressurized air, gas or fluids from the surface. Bleeding off the pressurized air, gas or fluids will cause the lower check valve to open, resulting in new wellbore fluids flowing into the area between the inner tube and the production tubing. Repeating the foregoing operation results in pumping of wellbore fluids to the surface.

DETAILED DESCRIPTION

Figure 1:
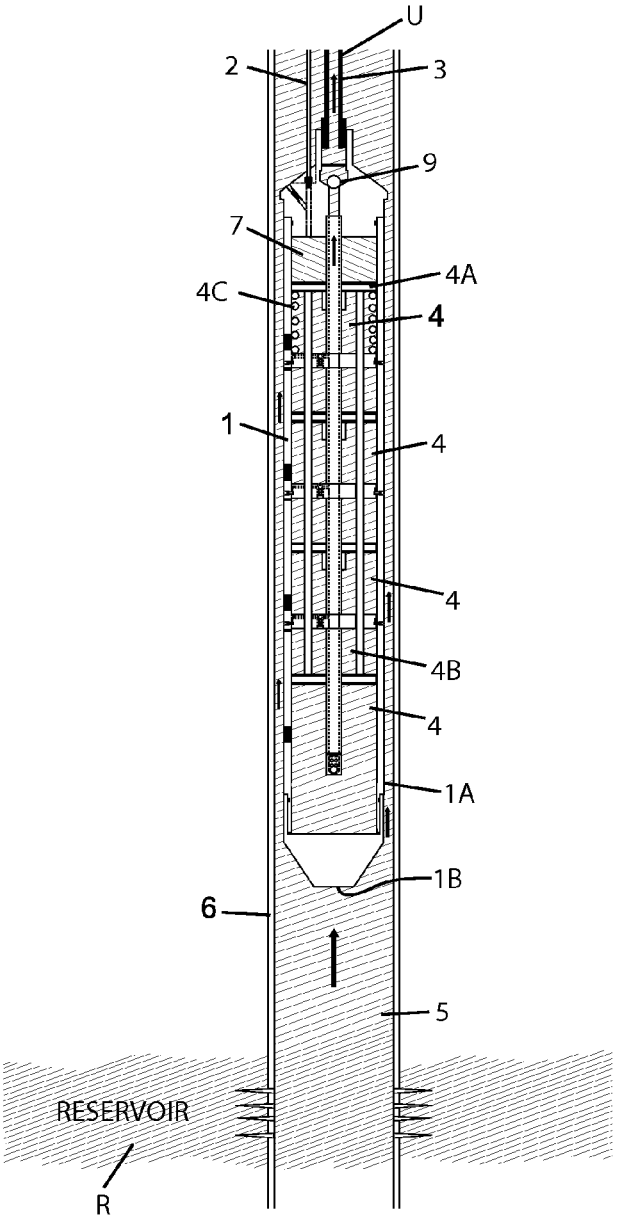
FIG. 1 illustrates a wellbore pump which operated by pneumatic or hydraulic pressure supplied by surface-deployed pump. Pressurizing a fluid tube from surface that is connected to the upper end of the wellbore pump results in the wellbore pump pushing reservoir produced fluids out of pump chambers into a centrally located discharge tube and then to the surface via a second connected tube connected thereto. Releasing the applied pressure results in the wellbore pump drawing fluids from a reservoir formation into the wellbore pump, as the pistons may be retracted by spring force.

FIG. 1 illustrates a wellbore pump (1) disposed within a wellbore (6). The pump (1) may be deployed into the wellbore (6) and suspended in the wellbore (6) by an umbilical U, examples of which include, without limitation, coiled tubing, jointed tubing and semi stiff spoolable rod. The umbilical U may include, in addition to strength members (not shown separately) a hydraulic or pneumatic power fluid tube (2) that may be routed to a surface-deployed pressure supply (not shown). The pressure supply (not shown) may provide pressurized air, gas or other fluids (hereinafter called "power fluid" 7) to the pump (1). The umbilical U may also include a produce fluid discharge tube (3) ("discharge tube") that is used to transport wellbore fluids (5) entering the wellbore (6) from a reservoir formation R to the surface. The power fluid (7) may be used to evacuate wellbore fluids (5) from one or more chambers (4) disposed in a pump housing (1A) by pushing down one or more pistons 4A that isolate the power fluid (7) from the wellbore fluids (5). Arrows in FIG. 1 illustrate the power fluid (7) and wellbore fluid (5) transport directions. As the piston(s) 4A are moved downwardly by the power fluid (7), the wellbore fluids (5) may be displaced from the interior of the housing (1A) into the discharge tube (3) and moved upwardly toward the surface. Motion of the wellbore fluid (5) may be limited to the directions shown by having a check valve (10 in FIG. 2) disposed proximate the pump intake (1B) as shown, and a check valve (9) proximate the housing's (1A) interior connection to the discharge tube (3).

More than one piston (4A) may be used to create multiple chambers (4) in the pump (1). The multiple pistons (4A) may be connected to each other by connecting rods (4B). At least one of the pistons (4A) may, when moved by the power fluid (7), act against a spring (4C) or other biasing device so that when the power fluid (7) pressure is bled off, the piston(s) (4A) are urged upwardly to enable refilling of the chamber(s) (4).

Figure 2:
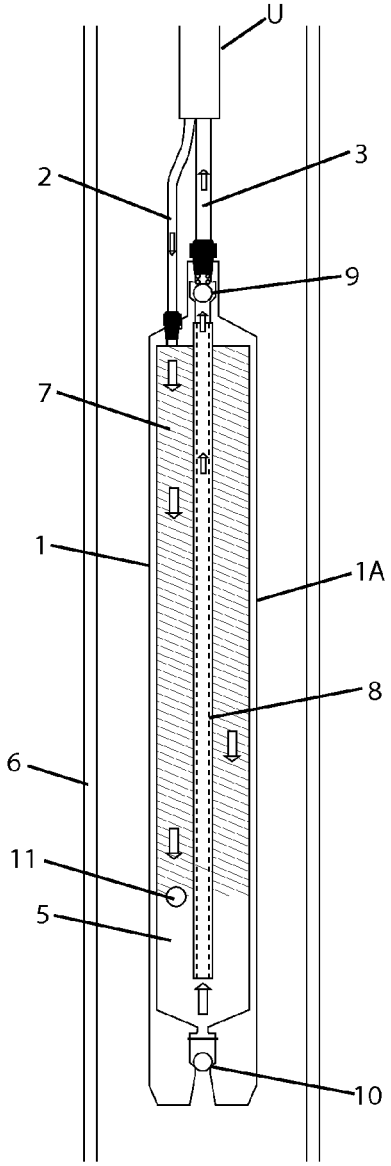
FIG. 2 illustrates a another embodiment of a submersible wellbore pump within a wellbore that is connected to a hydraulic power tube that may be routed to a surface hydraulic pressure supply providing high pressure air, gas or fluids. Arrows illustrate the gas, air and fluid transport direction.

FIG. 2 illustrates an example embodiment of a wellbore pump (1) suspended within a wellbore (6). The pump (1) may be deployed in the wellbore (6) and suspended therein by an umbilical U similar to the one shown in FIG. 1. The pump (1) may be connected to a power fluid tube (2) that may be routed to a surface-deployed pressure supply providing power fluid (7) just as for the pump explained with reference to FIG. 1. The umbilical U, in addition to the power fluid tube (2) may be accompanied by a discharge tube (3) that is used to transport wellbore fluids (5) to the surface. The power fluid (7) used to evacuate the wellbore fluids (5) that may be trapped in the pump housing (1A) by pushing wellbore fluids (5) out through an exhaust tube (8) disposed in the interior of the pump housing (1A), wherein the exhaust tube may be hydraulically connected to the discharge tube (3). Arrows illustrate power fluid (7) and wellbore fluid (5) transport direction. As the pump housing (1A) has wellbore fluid (5) displaced by power fluid (7), a check valve (10) may prevent escape of fluid through the pump intake (1B in FIG. 1).

FIG. 3 illustrates the pump described in FIG. 2, where the power fluid (7) is injected into the pump housing (1A) to push out trapped wellbore fluids (5) into the discharge tube (3) through the exhaust tube (8), which may be hydraulically coupled to the discharge tube (3). A check valve (10) at the pump intake will close by this action, while a check valve (9) in the discharge tube (3) will open. Continued injection of power fluid (7) will eventually evacuate all wellbore fluids (5) from the interior of pump housing (1A).

Figure 4:
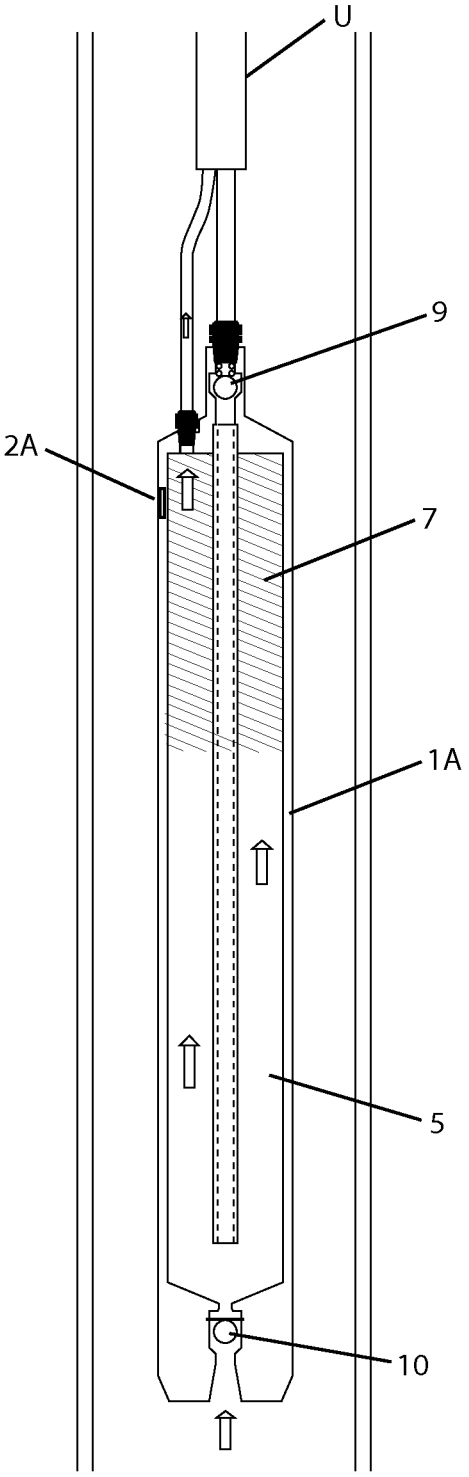
FIG. 4 illustrates the pump of FIG. 3 being refilled with wellbore fluids by bleeding off the pressurized air, gas or fluids from the surface. A device may be built into the pump to dump this pressurized air, gas or fluids into the wellbore instead of bleeding the pressure off to surface, which will increase operational speed of the pump. Bleeding off or dumping pressurized air, gas or fluids will result in the discharge check valve closing and the intake check valve opening.

FIG. 4 illustrates the pump (1) of FIGS. 2 and 3 being refilled with wellbore fluids (5) by bleeding off the pressure of the power fluid (7) from the surface. Another example may include a device such as a pop-off valve (2A) built into the pump (1) to dump the power fluid (7) into the wellbore instead of bleeding the pressure from surface, which will increase operational speed of the pump (1). Bleeding off, or dumping, the power fluid will result in discharge check valve (9) closing and the intake valve (10) opening. The pop off valve (2A) may be, for example, similar to a gas lift valve in that it may have a selected opening pressure and a lower closing pressure. Such different opening pressure and closing pressure may enable bleeding off the power fluid pressure by pressurizing it to the opening pressure, whereupon the power fluid (7) escapes into the wellbore (6) thus bleeding off the pressure. Once the power fluid (7) pressure drops below the closing pressure, the pop-off valve (2A) may close, once again enabling pressurizing the power fluid (7) inside the pump housing (1A).

Figure 5:
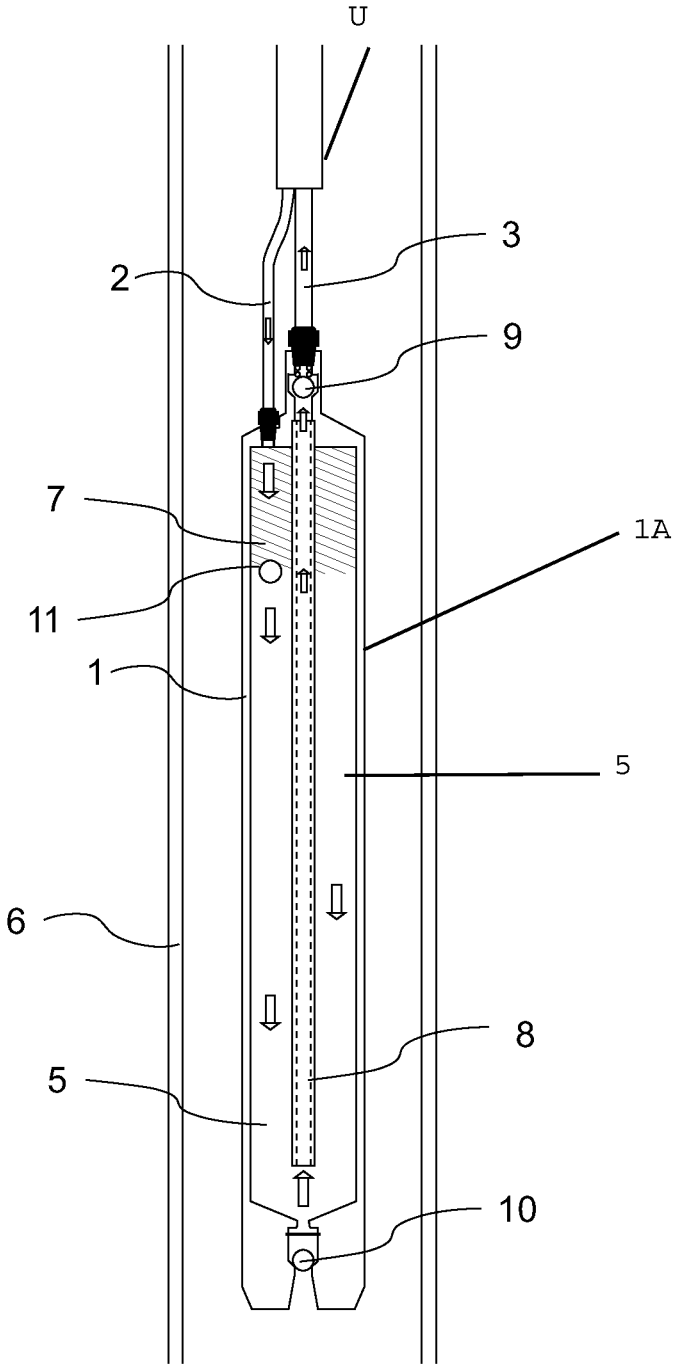
FIG. 5 illustrates the pump shown in FIGS. 2, 3 and 4 wherein a float ball is incorporated. The float ball will float on the interface between the air, gas or fluids and the wellbore fluids. When the wellbore fluids have been pushed out of the pump housing, the float ball will engage the lower end of the discharge tube where it will block off the discharge tube. The pressure of the power air, gas or fluid will sharply increase, indicating at surface that the pump housing has been emptied of wellbore fluid. Then, a built in logic system in the pump or the surface power fluid supply system can initiate refilling of the pump housing.

FIG. 5 illustrates another implementation of the pump shown in FIGS. 2, 3 and 4 including a float ball (11). The float ball (11) will float on an interface between the power fluid (7) and the wellbore fluids (5). When the wellbore fluids (5) have been pushed out of the pump housing (1A) by the pressure of the power fluid (7), the float ball (11) may engage the lower end of the exhaust tube (8), where it will block off the exhaust tube (8). The pressure of the power fluid (7) will then sharply increase, indicating that the pump housing (1A) has been emptied. Then, a built in logic system in the pump or the surface power fluid supply can then initiate refilling of the pump (1) by starting bleeding off pressure of the power fluid (7). The foregoing procedure may also be performed manually by observation of a pressure gauge (not shown) coupled to the power fluid supply (not shown) at the surface.

Figure 6:
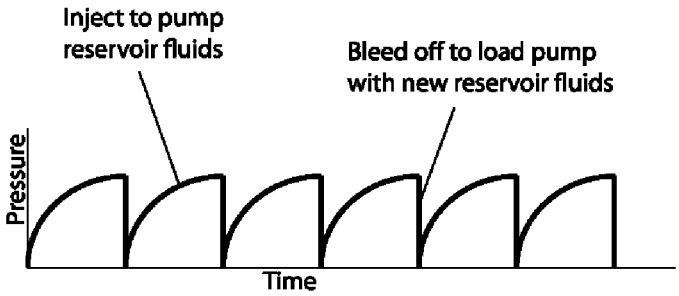
FIG. 6 illustrates a graph of pressure with respect to time of the continuous repeated pressurization and bleed-off sequence that operates the pump described in FIGS. 2, 3 and 4.

FIG. 6 shows a graph of power fluid pressure with respect to time of the repeated pump-in and bleed-off sequence that may operate the pump described with reference to FIGS. 2, 3 and 4.

Figure 7:
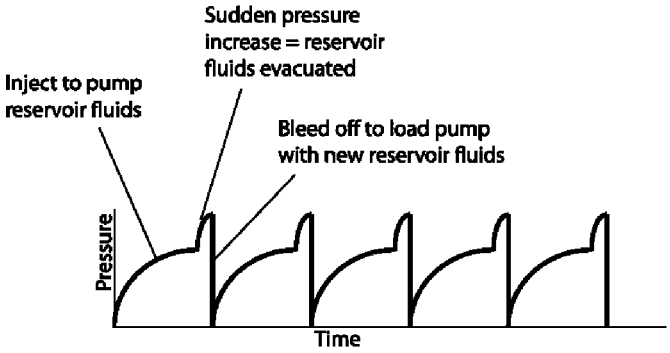
FIG. 7 illustrates a graph of pressure with respect to time of the pressurization and bleed-off sequence that operates the pump shown in FIG. 5. The sharp pressure increase observed is the result of the floating ball blocking off the lower end of the discharge tube.

FIG. 7 shows a graph of power fluid pressure with respect to time of the pump-in and bleed-off sequence that may operate the pump described with reference to FIG. 5. The sharp pressure increase observed is the result of the float ball (11 in FIG. 5) blocking off the lower end of the exhaust tube (8 in FIG. 5).

Figure 8:
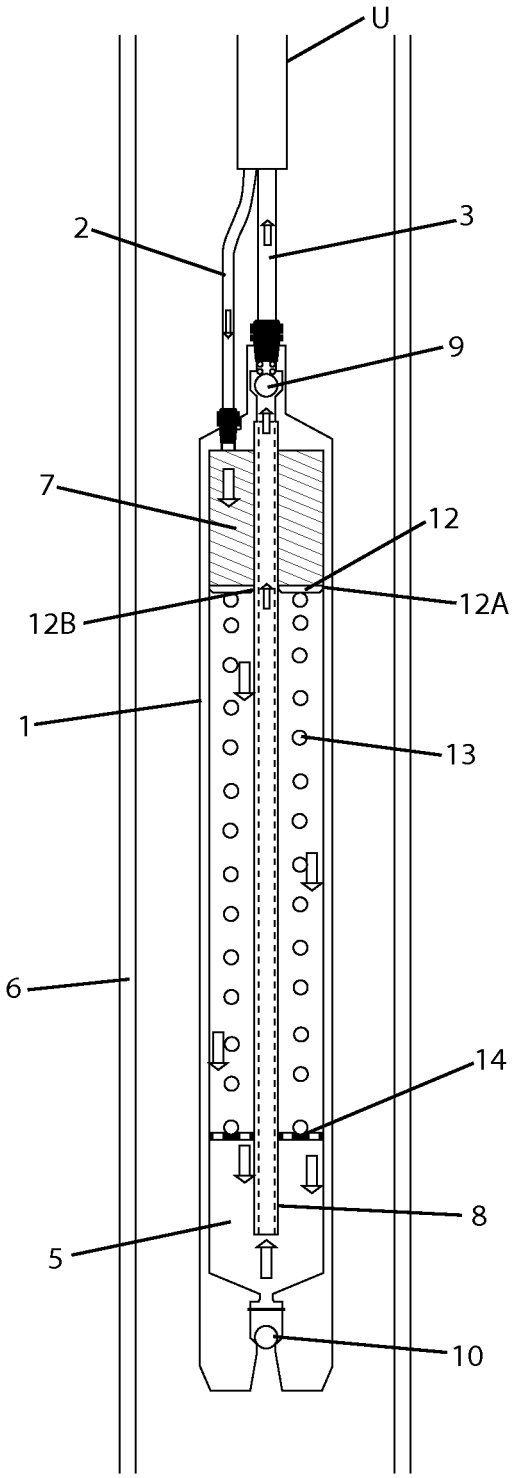
FIG. 8 illustrates a pump similar to that shown in FIGS. 2, 3 and 4, wherein a piston is included that is works against a spring supported by a ported seat, wherein the pump is activated by injecting pressurized air, gas or fluids. The piston separates the pressurized air, gas or fluids from the wellbore fluids while also creating an increased force to discharge the pressurized air, gas or fluids when bleeding off to refill the pump housing.

FIG. 8 illustrates a pump similar to that described with reference to FIGS. 2, 3 and 4, wherein a piston (12) with a dynamic seal (12A) against the inner wall of the pump housing (la) as well as a dynamic seal (12B) against the exhaust tube (8) may be included. The piston (12) works against a biasing device such as a spring (13). The spring (12) may be supported by a ported seat (14) when the pump (1) is activated by injecting power fluid (7). The piston (12) separates the power fluid (7) from the wellbore fluids (5), while also creating an increased force to expel the power fluid (7) back through the power fluid line (2) when bleeding off pressure thereof to refill the pump (1) with wellbore fluids (5). The dynamic seal (12, 12A) may expand toward the respective one of the inner housing (1A) wall and the exhaust tube (8) when power fluid pressure is applied from above the piston (12)

Figure 9:
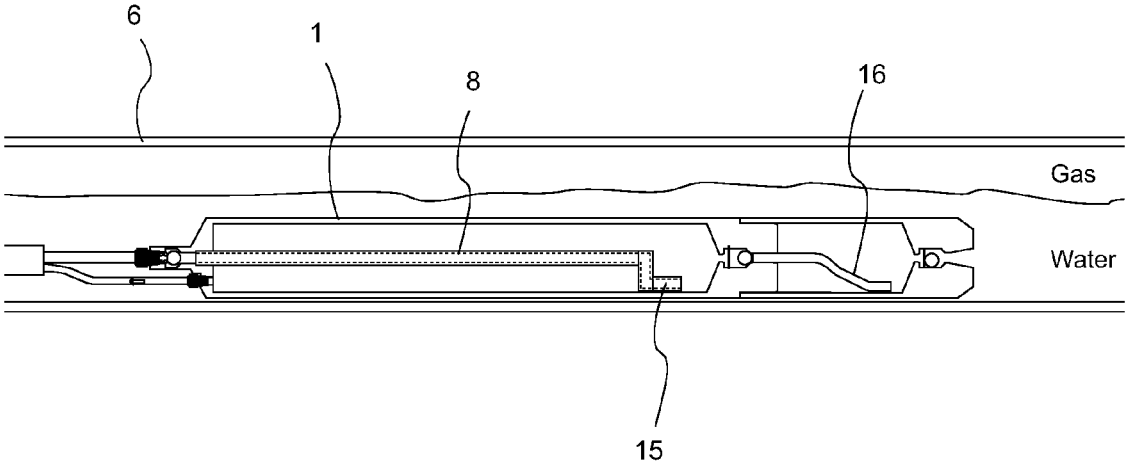
FIG. 9 illustrates another version of the pump described in FIGS. 2, 3 and 4 wherein the pump is configured to lift fluid out of highly deviated or horizontal wellbores. The pump will rest on the lower side of the wellbore by gravity wherein a weighted hose or the like coupled to the discharge tube will ensure fluid intake on the lower side of the pump. A similar weighted hose can be used to minimize intake of gas into the pump system.

FIG. 9 illustrates another example of the pump described with reference to FIGS. 2, 3 and 4 wherein the pump (1) is configured to lift fluids out of highly deviated or horizontal wells (6). The pump (1) may rest on the lower side of the wellbore (6) as a result of gravity, where either a weighted hose (15) or similar, coupled to the exhaust tube (8), will ensure fluid discharge from the lower side of the pump (1). A similar weighted hose (16) can be incorporated at the pump intake to ensure intake of fluid from the low side of the wellbore (6). The present example may have particular use in lifting water from wellbores in which accumulated produced water from the formations increases hydrostatic pressure against the formations, thus reducing wellbore hydrocarbon productivity. By lifting water from the lower side of the wellbore (6), the pump (1) may serve to reduce hydrostatic pressure, thus increasing wellbore productivity.

Figure 10:
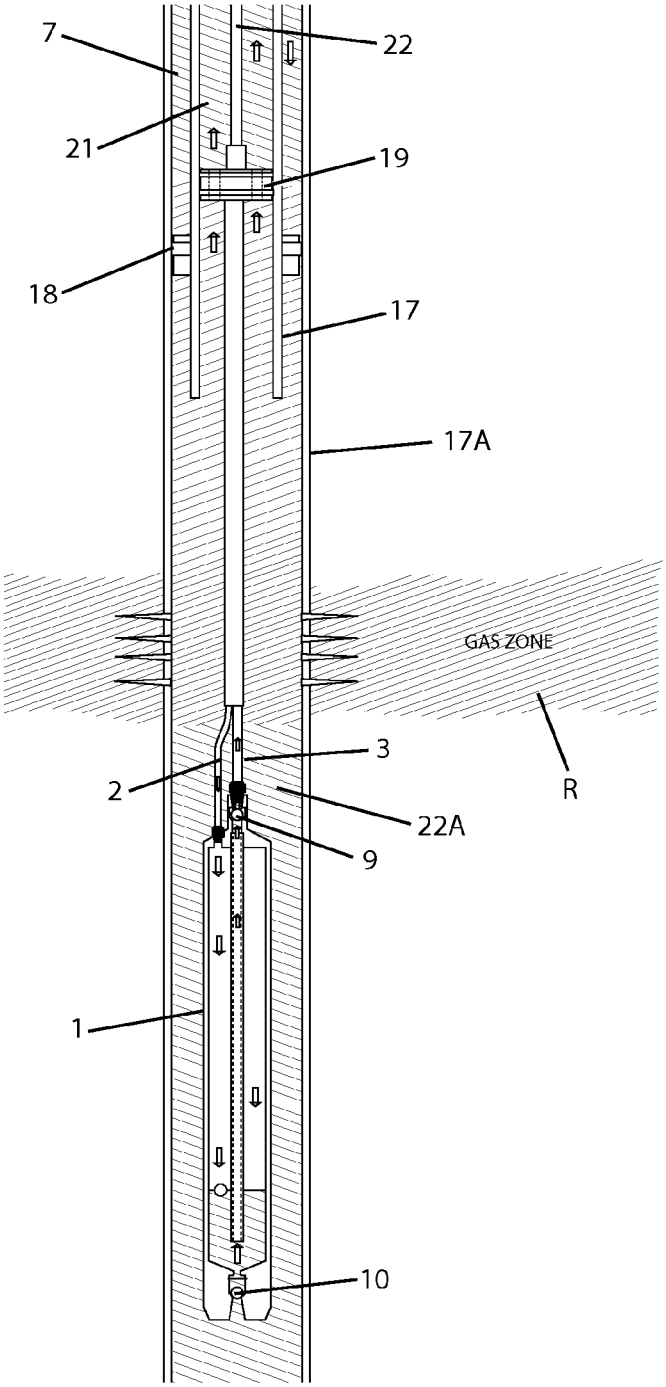
FIG. 10 illustrates an example installation method for the above describes pumps, where the pump is hung off in the wellbore at required location. The pump is coupled via an umbilical to a hang off mechanism placed within a section of a production tubing having one or several hydraulic communication ports to the area outside the production tubing The hang off mechanism may transfer pressurized air, gas or fluids to the pump. Wellbore fluids are transported to the surface via an hydraulic tube connected to an upper section of the hang off mechanism, while gas may be produced past the hang off mechanism within the tubing to the surface. Using such configuration, only one hydraulic tube is required to operate the pump from the surface, using the annular space between the tubing and a wellbore casing to move the pressurized air, gas or fluid to the pump.

The foregoing pumps explained with reference to FIGS. 1-9 may be deployed using a spoolable umbilical U. FIG. 10 illustrates another installation method for the above described pumps, where the pump (1) is hung off in the wellbore (6) at a selected axial position therein. The pump (1) may be coupled via an upper umbilical line (22) to a hang off mechanism (19) placed within a section of a production tubing (17). An umbilical U as in FIGS. 1-9 may be coupled to the bottom side of the hang off mechanism (19). The hang off mechanism (19) may be locked in place in the tubing (17) by any convenient locking mechanism known in the art, including without limitation, pressure set "dogs", J-slot actuated "dogs" or similar devices. The hang off mechanism (19) may have one or more hydraulic communication ports between the power fluid line (2) in the umbilical U to an annular space outside the tubing (17) and inside a wellbore casing (17A), wherein the hang off mechanism (19) transfers power fluid (7) to the power fluid line (2) and thence to the pump (1). Wellbore fluids (22A) are transported to the surface using tube (22) connected between the discharge tube (3) of the umbilical U through the hang off mechanism (19). Gas may be produced past the hang off mechanism (19) within the production tubing (17) to the surface. Using the foregoing, only one hydraulic tube is required to operate the pump from surface, by using the annular space between the tubing (17) and a casing string (17A) to transport the power fluid (7) to the pump (1). The foregoing configuration may require a seal (18) called a "packer" disposed in the annular space to separate the power fluid (7) from the wellbore fluid (22A). below the hang off mechanism (19) so that the power fluid (7) is directed into the power fluid line (2) and does not enter the wellbore (6) below the packer (18).

Figure 11:
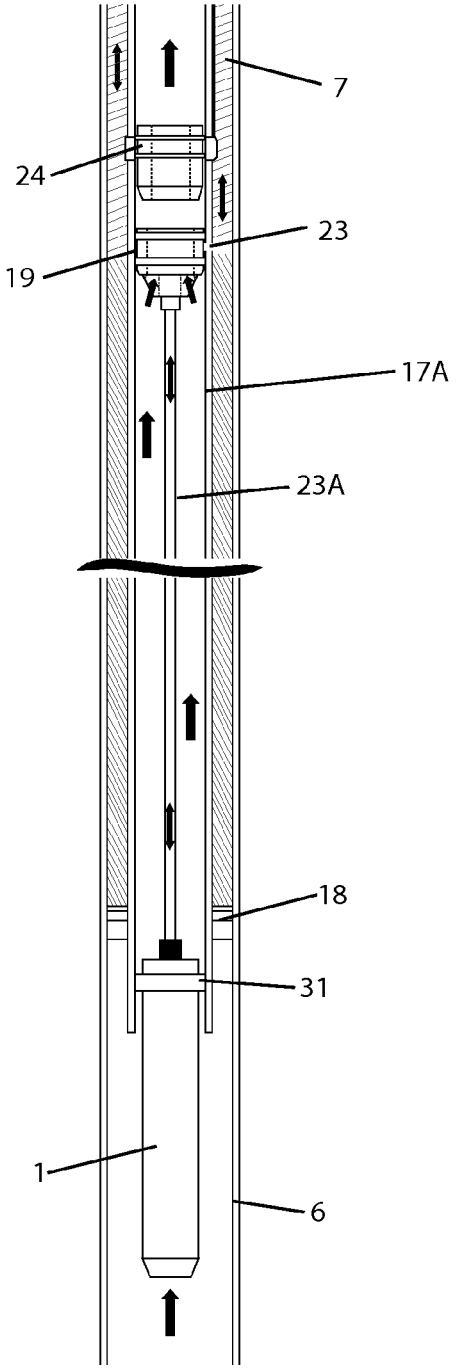
FIG. 11 illustrates using the above described pumps in a wellbore having a wellbore safety valve, where the wellbore safety valve would prevent any tubes or similar devices to be hung off within the production tubing. A communication port is located below the safety valve, wherein this port can be a perforation, a so-called sliding sleeve, a communication nipple or the like. Inside the communication port, a hang off mechanism is placed, allowing pressurized air, gas or fluids to be pumped into the wellbore pump via its umbilical, coupled between the wellbore pump and the hang off mechanism. This example allows pump installations in wellbores without having to install complicated bypass mechanisms in connection with the safety valve, and also removes the need for complicated an expensive changes in a wellhead at the surface.

FIG. 11 illustrates using the above described pump (1) in a wellbore having a wellbore safety valve (24) disposed within a production tubing (17) in the wellbore (6), wherein the safety valve (24) would otherwise prevent any tubes or devices to be hung off within the production tubing 17. The pump (1) may be suspended in the wellbore by the power fluid line (2 in FIG. 1) or the fluid discharge line (3 in FIG. 1). The present example uses the power fluid line to suspend the pump (1). The pump (1) includes an external annular seal (31) to seal the tubing (17) above and below the pump (1). The line (power fluid or discharge) that suspends the pump (1) may be coupled to a hang off mechanism (19) disposed in the tubing (17) below the safety valve (24). A communication port (23) or flow crossover may be disposed in the hang off mechanism (19) wherein the port (23) may be a perforation, a sliding sleeve, a pressure communication nipple or any similar fluid passage. The hang off mechanism (19), which can be any type of device that lockingly, sealingly engages an interior of a wellbore tubular is placed at a selected depth below the safety valve. In the present example power fluid (7) may be pumped down an annular space between the production tubing (17) and the wellbore casing (6) and into the pump (1) via a line (23A) coupled between the pump (1) and the hang off mechanism (19). Fluid discharged from the pump (1) may be directed into the interior of the production tubing (17) and move to the surface conventionally. The foregoing arrangement may allow pump installations in wellbores without having to install complicated bypass systems in connection with the safety valve (24), and may also eliminate the need for complicated and expensive changes in a wellhead system at the surface required for use with safety valve bypass systems known in the art.

Figure 12:
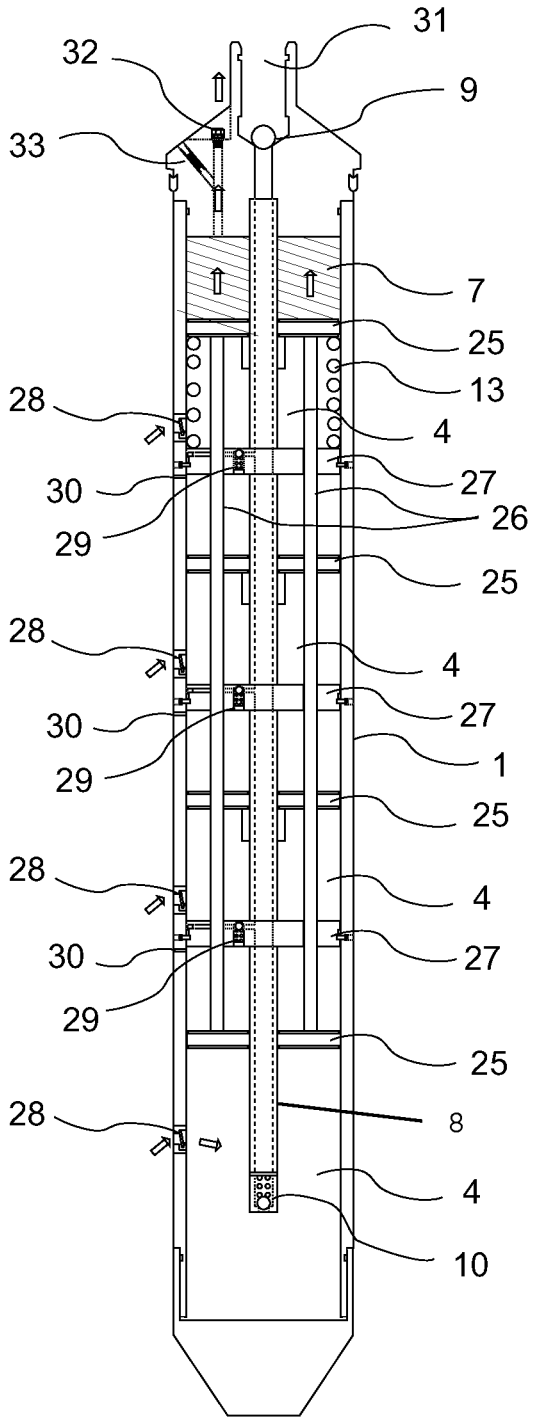
FIG. 12 illustrates the pump according to FIG. 1, wherein the pump may contain two or more chambers for wellbore fluids to be lifted to the surface. Pumping air, gas or fluids into the pump via the connection in the top of the pump pushes an upper piston against a spring so that wellbore fluids trapped within the chambers are forced into a centrally located discharge tube through check valves. The individual pistons may be coupled together by one or more travelling rods so that when the upper piston moves, the other piston(s) also move. When the pressurized air, gas or fluid is bled off, the spring pushes the upper piston, simultaneously moving the other piston(s). This generates a lower pressure within the pump chambers compared to outside the pump, resulting in wellbore fluids being drawn into the chambers via check valves.

FIG. 12 illustrates the pump according to FIG. 1, in more detail where the pump can contain two or more chambers (4) for wellbore fluids to be lifted to the surface. Pumping power fluid (7) into the pump (1) via a power fluid line connection (32) in the top of the pump (1) pushes an upper piston (2) against a spring (13) so that wellbore fluids trapped within the two or more chambers (4) may forced into the exhaust tube via check valves (9 and 10). The individual pistons (25) may be coupled together by several travelling rods (26) so that when the upper piston moves, the other pistons also move. When the power fluid (7) pressure is bled off, the spring (13) pushes the upper piston (25) up, simultaneously pulling the other pistons up also. This generates a lower pressure within the pump chambers (4) compared to the fluid pressure outside the pump (1), resulting in new wellbore fluids being drawn into the chambers via check valves (28).

Arrows illustrate gas, air and fluids transport direction. A check valve (9) in the fluid discharge line prevents fluids already pushed out of the pump to be drawn back into the pump. An overpressure valve (32) may be incorporated in the top of the pump to avoid over-pressurizing the pump. Alternatively a "smart" valve arrangement, can replace this overpressure valve, where the "smart" valve arrangement would dump power fluid into the wellbore (6 in FIG. 1) instead of bleeding the pressure to surface via the power fluid tube (2 in FIG. 1), while temporarily isolating the high pressure feed line into the pump. This may increase the pump operating rate.

FIG. 13 illustrates a free hanging pump (1) as described with reference to previous figures, where this illustration describes how a pump can be deployed within a tubular (6) that can be tubing or casing, where wellbore fluids are pushed to the surface through a dedicated spooled or jointed discharge tube (3).

FIG. 14 illustrates a pump (1) as described with reference to the previous figures, wherein the pump in FIG. 14 may be hung off within a wellbore tubular (36) onto a pre-installed or intervention installed hanger (34). The pump housing will contain a seal assembly (35) cooperatively engageable with the hanger (34) so that wellbore fluids pumped into the wellbore above the pump (as explained, for example with reference to FIGS. 2, 3 and 4) will not return to below the pump because the interior of the wellbore (6) above the pump is isolated from the interior of the wellbore below the pump the by the combination hanger (34) and seal assembly. The forgoing arrangement only requires the power fluid tube (2), which may be used to deploy the pump, thus removing the need for a separate discharge tube (3 in FIG. 13) to transport wellbore fluids to the surface; transport thereof may be within the wellbore (6) itself.

FIG. 15 illustrates a pump using tubulars extended from the surface, where an inner jointed or coiled tube (38) is hung off within a production tubing string (37) that has at least one opening or port (36) to enable power air or gas (7) to be injected from the surface through the annular space between the wellbore (6) (shown as cased) and the production tubing (37). An annular space between the production tubing (37) and the casing (6) may be sealed with an annular seal such as a packer (18). The inner tube (38) contains a check valve (39) to prevent wellbore fluids moved into the inner tube (38) from draining back into the wellbore (6). The production tubing (37) also contains a check valve (40) that prevents wellbore fluids from draining into the wellbore (6) as well as providing a pressure lock when pumping in power air or gas (7) from the surface. When pumping in the power air or gas (7) into the annular space between the production tubing (37) and the inner tube (38), the air or gas will displace any reservoir fluid being present in therein into the inner tube (38) through its check valve (39). Bleeding off the pressure of the power air or gas will cause the lower check valve (40) to open, resulting in new wellbore fluids flowing into the annular space between the inner tube (38) and the production tubing (37). Repeating the foregoing pressurizing and bleed off operation results in a repeated pumping of wellbore fluids to the surface.

Those skilled in the art will understand that the check valves can be ball type, poppet type, flapper type or other. It will also be understood that these check valves can be retrofitted into already installed tubulars by for example standard wireline methods.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A wellbore pump, comprising:

a pump housing suspendible in a wellbore at ends of a power fluid line and a fluid discharge line, the pump housing including a fluid inlet proximate a bottom end thereof and wherein the fluid discharge line is coupled proximate a top end thereof;

valves for directing flow of a wellbore fluid to the discharge line when a power fluid displaces fluid in the housing, the valves for directing flow of the wellbore fluid into the housing when power fluid pressure is relieved;

a fluid exhaust tube extending from the discharge line to proximate a bottom of the interior of the housing, wherein the wellbore fluid displaced by the power fluid is urged into the exhaust tube; and a float ball disposed within the housing and configured to float on an interface between the power fluid and the wellbore fluid, the float ball configured to close an inlet to the fluid exhaust tube when the interface drops below the inlet of the fluid exhaust tube.

2. The wellbore pump of claim 1 further comprising means for dumping the power fluid from the interior of the pump housing to the wellbore.

3. The wellbore pump of claim 2 wherein the means for dumping comprises a pop off valve having an opening pressure and a closing pressure, the opening pressure higher than the closing pressure.

4. The wellbore pump of claim 1 wherein the power fluid line and the fluid discharge line extend to the surface.

5. The wellbore pump of claim 1 wherein the power fluid line and the fluid discharge line extend to a pump hangoff, the pump hangoff comprising a communication port coupled between one of the power fluid line and the fluid discharge line and an annular space between a wellbore casing and a producing tubing disposed in the casing, wherein the other of the fluid discharge line and the power fluid line alone extends to the surface.

6. A wellbore pump, comprising:

a pump housing suspendible in a wellbore at an ends of a power fluid line, the pump housing including a fluid inlet proximate a bottom end thereof and wherein a fluid discharge line is coupled proximate a top end thereof;

a hangoff engageable with an interior of a tubing disposed within a casing in the wellbore, the hangoff including a communication port between an annular space between the tubing and the casing and the power fluid line;

valves for directing flow of a wellbore fluid to an interior of the tubing when power fluid displaces fluid in the housing, the valves for directing flow of the wellbore fluid into the housing when power fluid pressure is relieved;

a fluid exhaust tube extending from the discharge line to proximate a bottom of the interior of the housing, wherein the wellbore fluid displaced by the power fluid is urged into the exhaust tube; and a float ball disposed within the housing and configured to float on an interface between the power fluid and the wellbore fluid, the float ball configured to close an inlet to the fluid exhaust tube when the interface drops below the inlet of the fluid exhaust tube.

7. The wellbore pump of claim 6 further comprising means for dumping the power fluid from the interior of the pump housing to the wellbore.

8. The wellbore pump of claim 7 wherein the means for dumping comprises a pop off valve having an opening pressure and a closing pressure, the opening pressure higher than the closing pressure.

* * * * *